US008134585B2

(12) United States Patent
Ohno et al.

(10) Patent No.: US 8,134,585 B2
(45) Date of Patent: Mar. 13, 2012

(54) LIGHT-EMITTING ELEMENT HEAD, IMAGE FORMING APPARATUS AND LIGHT-EMISSION CONTROL METHOD

(75) Inventors: Seiji Ohno, Tokyo (JP); Toshihiko Furuichi, Mie (JP)

(73) Assignee: Fuji Xerox Co., Ltd., Tokyo (JP)

( * ) Notice: Subject to any disclaimer, the term of this patent is extended or adjusted under 35 U.S.C. 154(b) by 145 days.

(21) Appl. No.: 12/550,668

(22) Filed: Aug. 31, 2009

(65) Prior Publication Data

US 2010/0157010 A1 Jun. 24, 2010

(30) Foreign Application Priority Data

Dec. 18, 2008 (JP) ..... 2008-321847

(51) Int. Cl.
*B41J 2/435* (2006.01)
*B41J 2/47* (2006.01)

(52) U.S. Cl. ..... 347/237; 347/247

(58) Field of Classification Search ..... 347/237, 347/238, 247
See application file for complete search history.

(56) References Cited

U.S. PATENT DOCUMENTS 5,177,405 A 1/1993 Kusuda et al.
5,451,977 A 9/1995 Kusuda et al.
5,814,841 A * 9/1998 Kusuda et al. ..... 257/113
6,531,826 B1 * 3/2003 Ohno et al. ..... 315/169.3
6,611,280 B1 * 8/2003 Shiraishi et al. ..... 347/238
6,747,940 B2 * 6/2004 Ohno ..... 369/121
7,122,834 B2 10/2006 Ogihara et al.
2004/0130015 A1 7/2004 Ogihara et al.

FOREIGN PATENT DOCUMENTS

| | | | |
|---|---|---|---|
| EP | 2006918 | A2 * | 12/2008 |
| JP | 01-238962 | | 9/1989 |
| JP | 02-014584 | | 1/1990 |
| JP | 02-092650 | | 4/1990 |
| JP | 02-092651 | | 4/1990 |
| JP | 02-263668 | | 10/1990 |
| JP | 2004-207444 | | 7/2004 |

* cited by examiner

*Primary Examiner* — Hai C Pham
(74) *Attorney, Agent, or Firm* — Fildes & Outland, P.C.

(57) ABSTRACT

A light-emitting element head includes: plural light-emitting element array chips that are divided into plural groups and that each are provided with light-emitting elements arranged in an array; a signal generation unit that generates a light-emission control signal for controlling blinking of the light-emitting elements, and an identification signal for identifying which of the light-emitting element array chips in each of the groups the light-emission control signal is for; signal lines through which the light-emission control signal and the identification signal are transmitted; and identification signal discrimination units that are connected to the signal lines and that are provided in the respective light-emitting element array chips, each of the identification signal discrimination units discriminating the identification signal, and transmitting the light-emission control signal to the light-emitting elements.

10 Claims, 11 Drawing Sheets

LIGHT-EMITTING ELEMENT HEAD, IMAGE FORMING APPARATUS AND LIGHT-EMISSION CONTROL METHOD

CROSS REFERENCE TO RELATED APPLICATIONS

This application is based on and claims priority under 35 USC §119 from Japanese Patent Application No. 2008-321847 filed Dec. 18, 2008.

BACKGROUND

1. Technical Field

The present invention relates to a light-emitting element head, an image forming apparatus and a light-emission control method using the light-emitting element head.

2. Related Art

In an electrophotographic image forming apparatus such as a printer, a copier or a facsimile machine, an image is formed on a recording paper sheet as follows. Firstly, an electrostatic latent image is formed on a uniformly charged photoconductor by causing an optical recording unit to emit light so as to transfer image information onto the photoconductor. Then, the electrostatic latent image is made visible by being developed with toner. Lastly, the toner image is transferred on and fixed to the recording paper sheet. In addition to an optical-scanning recording unit that performs exposure by laser scanning in the first scan direction using a laser beam, an optical recording unit using the following light emitting diode (LED) head has been employed as such an optical recording unit in recent years. This LED head includes a large number of LED array light source arrayed in the first scan direction.

SUMMARY

According to an aspect of the present invention, there is provided a light-emitting element head including: plural light-emitting element array chips that are divided into plural groups and that each are provided with light-emitting elements arranged in an array; a signal generation unit that generates a light-emission control signal for controlling blinking of the light-emitting elements, and an identification signal for identifying which of the light-emitting element array chips in each of the groups the light-emission control signal is for; signal lines through which the light-emission control signal and the identification signal are transmitted; and identification signal discrimination units that are connected to the signal lines and that are provided in the respective light-emitting element array chips, each of the identification signal discrimination units discriminating the identification signal, and transmitting the light-emission control signal to the light-emitting elements.

BRIEF DESCRIPTION OF THE DRAWINGS

Exemplary embodiment(s) of the present invention will be described in detail based on the following figures, wherein.

DETAILED DESCRIPTION

Hereinafter, a detailed description will be given of a best mode (hereinafter referred to as exemplary embodiment) for carrying out the present invention. Note that the present invention is not limited to the following exemplary embodiments, but may be implemented in various modified forms within the gist of the present invention. In addition, the drawings referred to herein are not to show actual sizes but are used to illustrate the exemplary embodiments.

Figure 1:
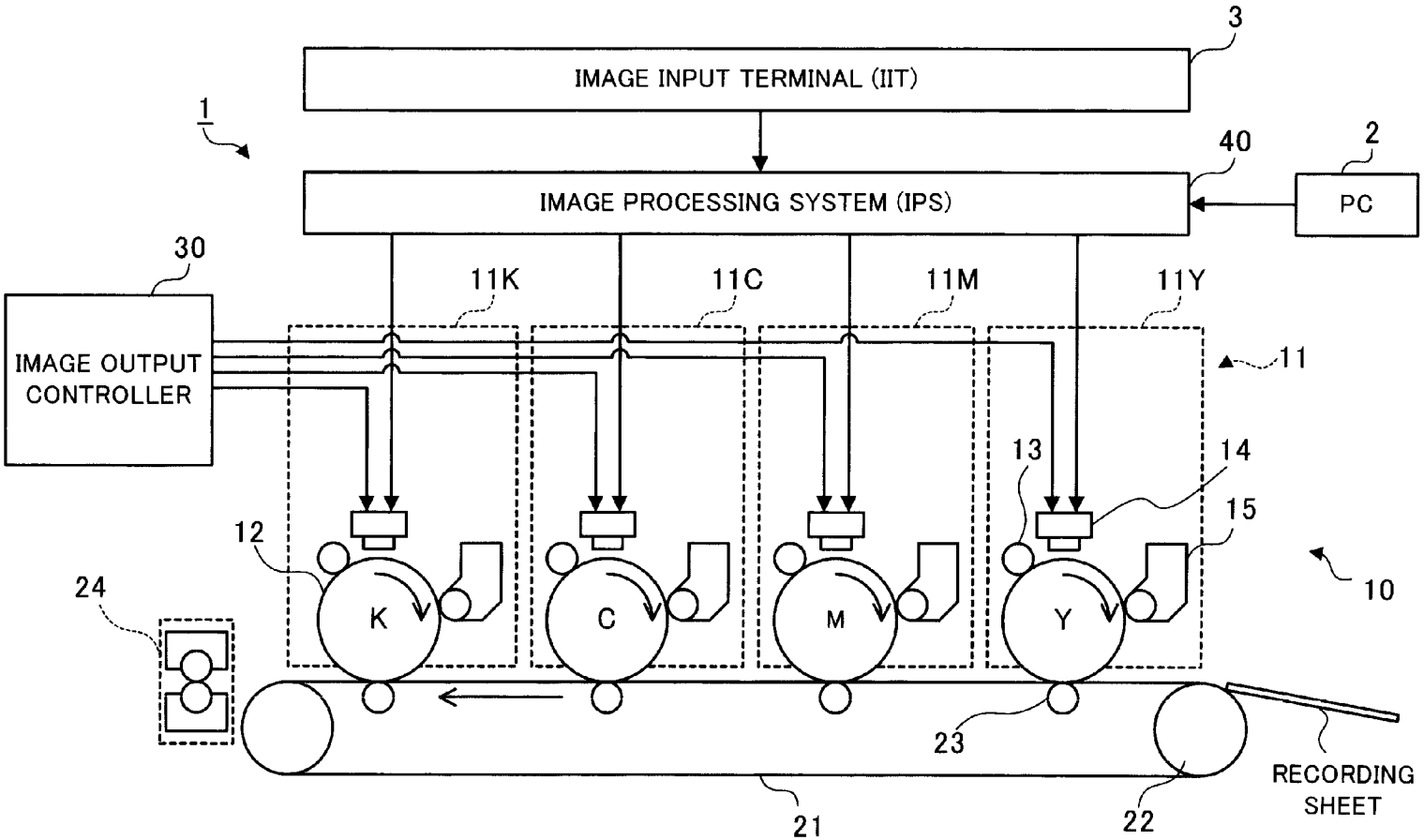
FIG. 1 is a diagram showing an overall configuration of an image forming apparatus to which the present exemplary embodiment is applied.

FIG. 1 is a diagram showing an overall configuration of an image forming apparatus 1 to which the present exemplary embodiment is applied.

The image forming apparatus 1 shown in FIG. 1 is what is generally termed as a tandem image forming apparatus. The image forming apparatus 1 includes an image formation processing system 10, an image output controller 30 and an image processing system (IPS) 40. The image formation processing system 10 forms an image in accordance with different color tone data sets. The image output controller 30 controls the image formation processing system 10. The IPS 40, which is connected to devices such as a personal computer (PC) 2 and an image input terminal (IIT) 3, performs predefined image processing on image data received from the above devices.

The image formation processing system 10 includes image forming units 11 as an example of a toner image forming unit. The image forming units 11 are formed of multiple engines placed in parallel at regular intervals in the horizontal direction. Specifically, the image forming units 11 are composed of four units: a yellow (Y) image forming unit 11Y, a magenta (M) image forming unit 11M, a cyan (C) image forming unit 11C and a black (K) image forming unit 11K. Each image forming unit 11 includes a photoconductive drum 12, a charging device 13, a light-emitting element head 14 and a developing device 15. On the photoconductive drum 12, which is an image carrier (photoconductor), an electrostatic latent image is formed and thus a toner image is formed. The charging device 13 uniformly charges the surface of the photoconductive drum 12. The light-emitting element head 14, which is a light-emitting device, exposes the photoconductive drum 12 charged by the charging device 13. The developing device 15 develops a latent image formed by the light-emitting element head 14. In addition, the image formation processing system 10 further includes a sheet transport belt 21, a drive roll 22 and transfer rolls 23. The sheet transport belt 21 transports a recording sheet, which is as an example of a recording medium, so that color toner images respectively formed on the photoconductive drums 12 of the image forming units 11Y, 11M, 11C and 11K are transferred on the recording sheet by multilayer transfer. The drive roll 22 drives the sheet transport belt 21. Each transfer roll 23 as an example of a transfer unit transfers the toner image formed on the corresponding photoconductive drum 12 onto a recording sheet.

The image forming units 11Y, 11M, 11C and 11K have approximately the same configuration excluding toner put in the developing device 15. On image signals inputted from the PC 2 or the IIT 3, image processing is performed by the IPS 40. The resultant signals are supplied to the respective image forming units 11Y, 11M, 11C and 11K through an interface. The image processing system 10 operates based on control signals, such as a synchronizing signal, supplied by the image output controller 30. Firstly, in the yellow image forming unit 11Y, based on the image signal supplied from the IPS 40, the light-emitting element head 14 forms an electrostatic latent image on the surface of the photoconductive drum 12 charged by the charging device 13. Then, the developing device 15 forms a yellow toner image from the formed electrostatic latent image. By using the corresponding transfer roll 23, the yellow image forming unit 11Y transfers the formed yellow toner image on a recording sheet being transported on the sheet transport belt 21 that rotates in the direction indicated by the arrow in FIG. 1. Similarly, magenta, cyan and black toner images are respectively formed on the photoconductive drums 12. After that, by using the corresponding transfer rolls 23, these color toner images are transferred by multilayer transfer on the recording sheet transported on the sheet transport belt 21. Then, the recording sheet is transported to a fixing device 24, which is as an example of a fixing unit. In fixing device 24, the toner images transferred by multilayer transfer on the recording sheet are fixed on the recording sheet with heat and pressure.

Figure 2:
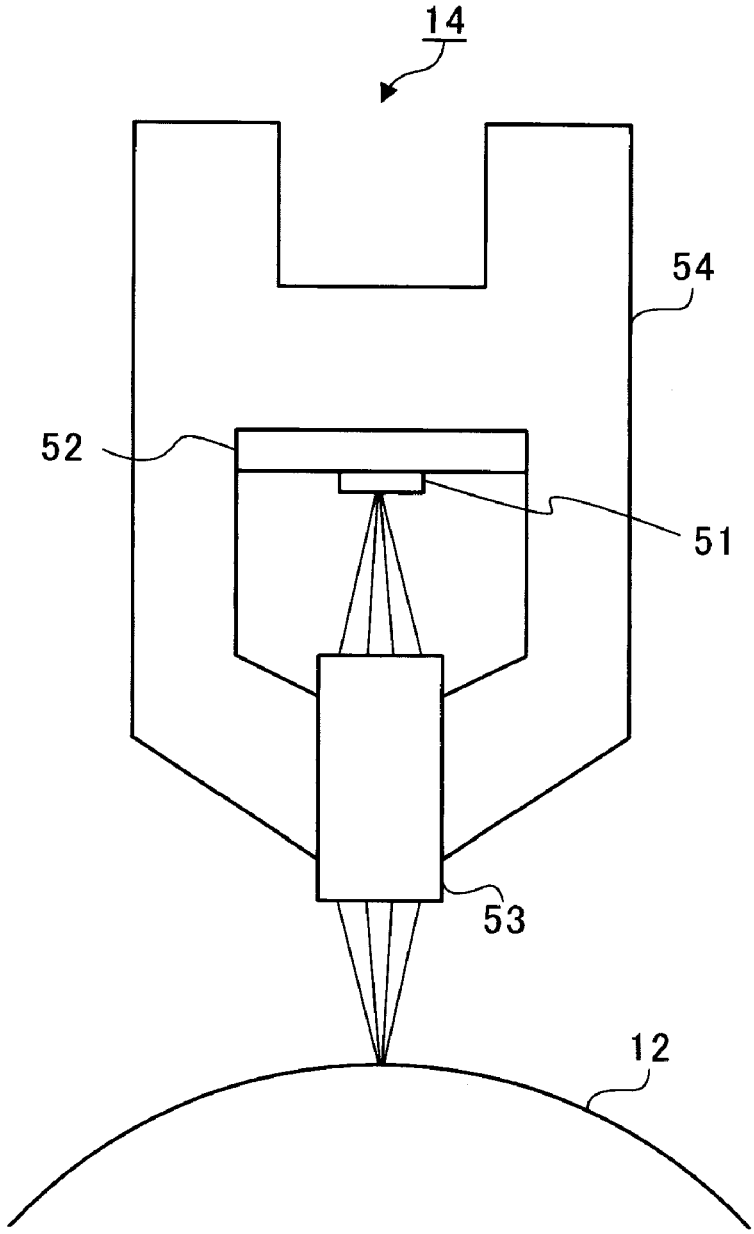
FIG. 2 is a diagram showing a structure of the light-emitting element head to which the present exemplary embodiment is applied.

FIG. 2 is a diagram showing a structure of the light-emitting element head 14 to which the present exemplary embodiment is applied.

The light-emitting element head 14 includes a light-emitting element array 51, a printed circuit board 52 and a SELFOC lens array (SLA: registered trademark) 53. The light-emitting element array 51 is an array of a large number of LEDs, each being a recording element (light-emitting element). The printed circuit board 52 supports the light-emitting element array 51, and on the printed circuit board 52, a circuit that controls drive of the light-emitting element array 51 is mounted. The SELFOC lens array 53, which is an optical element, focuses a light output emitted by each of the LEDs onto the surface of the photoconductive drum 12. The printed circuit board 52 and the SELFOC lens array 53 are held by a housing 54. Specifically, the light-emitting element array 51 is formed of as many LEDs as corresponding to the number of pixels arrayed in the first scan direction. For example, suppose a case where the shorter side (297 mm) of an A3-size recording sheet is set as the first scan direction, and where the output resolution is 600 dpi. In this case, the light-emitting element array 51 is formed of 7040 LEDs arrayed at intervals of approximately 42.3 μm. Note that, in the present exemplary embodiment, the LEDs are arrayed in a straight line, and the light-emitting element array 51 is actually formed of 7680 LEDs in consideration of side-to-side misregistration and the like.

Figure 3:
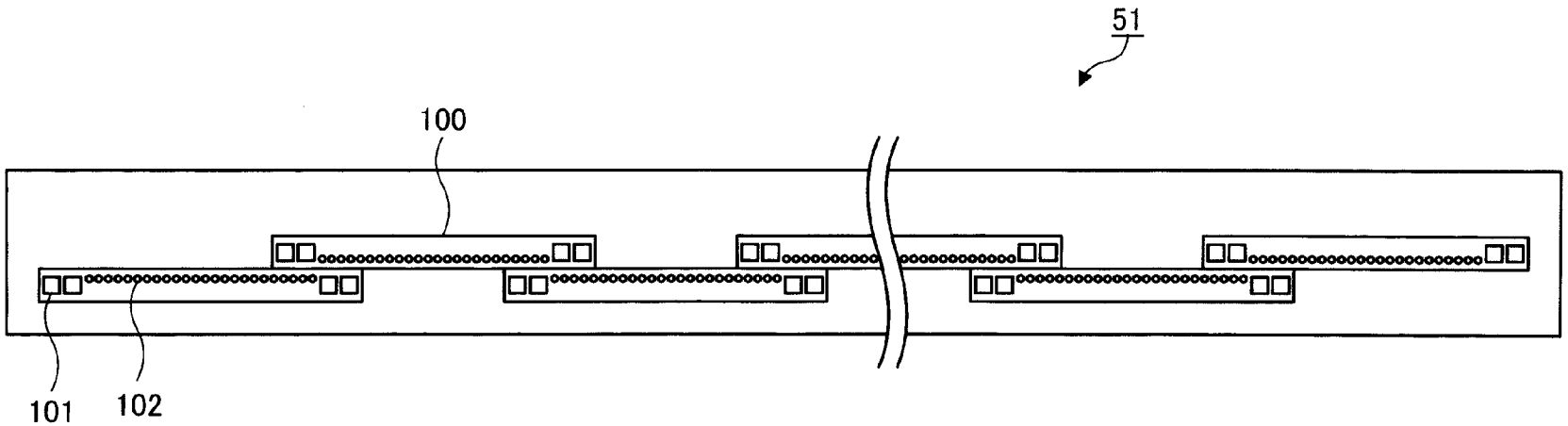
FIG. 3 is a diagram illustrating a structure of the light-emitting element array.

FIG. 3 is a diagram illustrating a structure of the light-emitting element array 51.

The light-emitting element array 51 shown in FIG. 3 includes multiple light-emitting element array chips 100 arrayed in a zigzag pattern in the first scan direction.

Each light-emitting element array chip 100 is rectangular, and includes bonding pads 101, which are spaces for connecting wiring and the like thereto, on both sides. Providing the bonding pads 101 as described above has an advantage of allowing the chip width to be reduced to approximately the value required for a single bonding pad 101 itself.

In a region sandwiched between the bonding pads 101 on both sides of the light-emitting element array chip 100, LEDs 102, each serving as a light-emitting element, are arrayed at equal intervals in a straight line extending along a longer side of the rectangular light-emitting element array chip 100, namely, extending in the first scan direction. Here, the LEDs 102 are placed near one of the longer sides of the light-emitting element array chip 100. The light-emitting element array chips 100 are arrayed so that the longer side near the LEDs 102 of each of the odd-numbered light-emitting element array chips 100 faces that of adjacent one of the even-numbered light-emitting element array chips 100, and that the bonding pads 101 of each adjacent pair of odd-numbered and even-numbered light-emitting element array chips 100 have an overlapping portion. This layout allows all the LEDs 102 to be arrayed in the first scan direction at equal intervals.

Figure 4A:
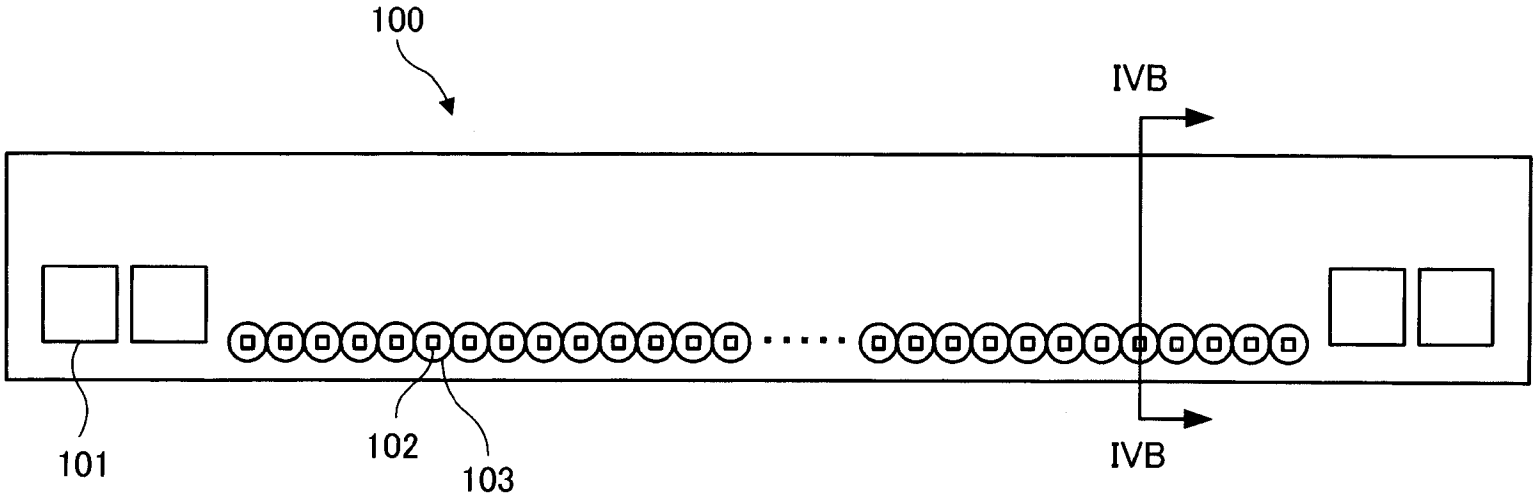
FIGS. 4A and 4B are diagrams illustrating a structure of the light-emitting element array chip.
Figure 4B:
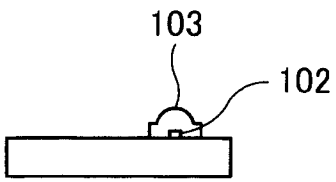

In addition, a microlens 103 is attached onto each LED 102 (see FIGS. 4A and 4B).

FIGS. 4A and 4B are diagrams illustrating a structure of each light-emitting element array chip 100.

FIG. 4A is a view of the light-emitting element array chip 100 as viewed from the side from which the LEDs 102 emit light. FIG. 4B is an IVB-IVB cross-sectional view of FIG. 4A.

As described above, the light-emitting element array chip 100 is provided with the bonding pads 101 on both sides thereof, and the LEDs 102 are arrayed at equal intervals in a straight line in the region sandwiched between the bonding pads 101 on both sides. In addition, on each LED 102, the microlens 103 is formed on the light-emitting side. The microlens 103 is capable of collecting light emitted by the corresponding LED 102, and thus making the light effectively incident on the photoconductive drum 12 (see FIG. 2).

The microlens 103 is made of transparent resin such as photocurable resin, and may have an aspherical surface in order to collect light more effectively. The properties of the microlens 103, such as the size, the thickness and the focal length, are determined based on the wavelength of each employed LED 102, the refractive index of the employed photocurable resin, and the like.

Note that, in the exemplary embodiment, a self-scanning light-emitting element array chip may be used as the light-emitting element array chip 100. The self-scanning light-emitting element array chip is a light-emitting element array chip using, as components, light-emitting thyristors each having a pnpn structure so as to allow each light-emitting element therein to self-scan. The self-scanning light-emitting element array chip is disclosed in Japanese Patent Application Laid Open Publication Nos. 1-238962, 2-14584, 2-92650, and 2-92651. Meanwhile, Japanese Patent Application Laid Open Publication No. 2-263668 discloses a self-scanning light-emitting element array chip having a structure in which a transfer element array is formed as a transfer portion separated from a light-emitting element array serving as a light-emitting portion.

Figure 5:
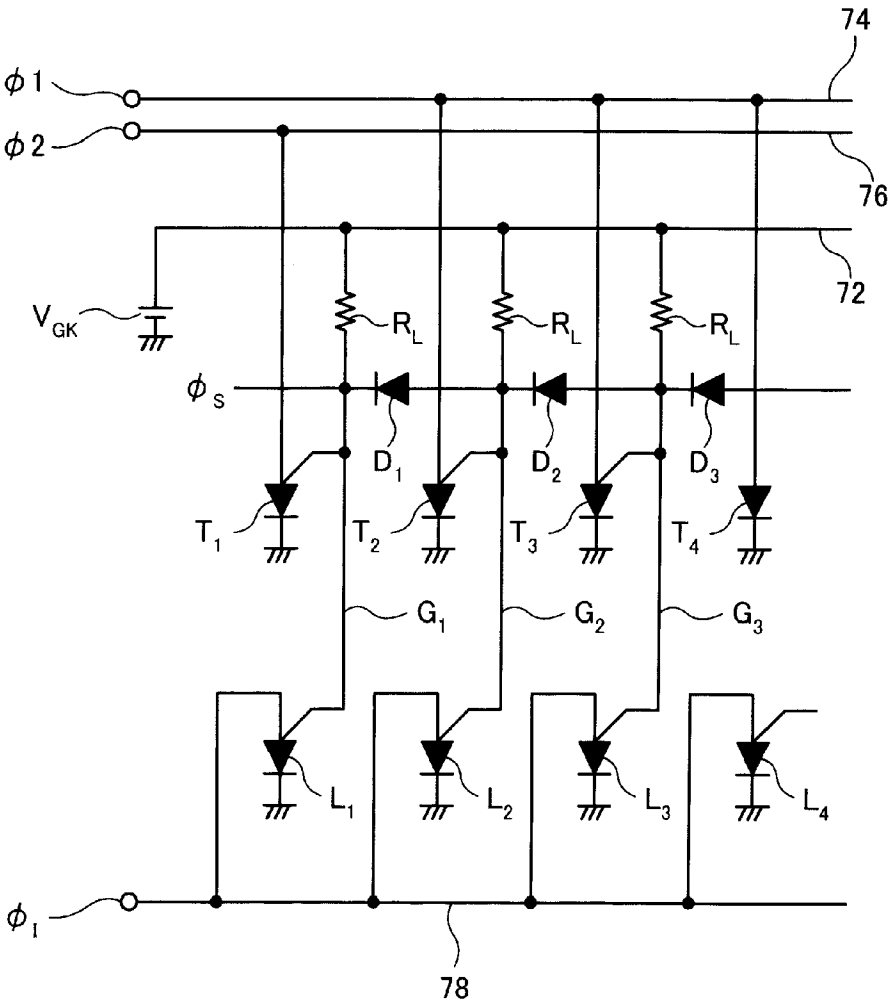
FIG. 5 is an equivalent circuit diagram of a self-scanning light-emitting element array chip of a separation type.

FIG. 5 is an equivalent circuit diagram of a self-scanning light-emitting element array chip of a separation type. The self-scanning light-emitting element array chip includes transfer thyristors $T_1$, $T_2$, $T_3$, . . . , and writing light-emitting thyristors $L_1$, $L_2$, $L_3$, . . . . A transfer portion thereof is configured using diode connection. $V_{GK}$ denotes a power supply (normally 5 V), which is connected to a power supply line 72 connected to gate electrodes $G_1$, $G_2$, $G_3$, . . . of the transfer thyristors $T_1$, $T_2$, $T_3$, . . . via load resistors $R_L$, respectively. In addition, the gate electrodes $G_1$, $G_2$, $G_3$, . . . of the transfer thyristors $T_1$, $T_2$, $T_3$, . . . are also connected to gate electrodes of the writing light-emitting thyristors $L_1$, $L_2$, $L_3$, . . . , respectively. The gate electrode of the transfer thyristor $T_1$ is supplied with a start pulse $\phi_S$, while anode electrodes of the respective transfer thyristors are alternately supplied with transfer clock pulses $\phi$1 and $\phi$2. These clock pulses $\phi$1 and $\phi$2 are supplied through clock pulse lines 74 and 76, respectively. Meanwhile, anode electrodes of the respective writing light-emitting thyristors are supplied with a write signal $\phi_I$ through a write signal line 78.

Next, the operation will be briefly described. Assume that the transfer clock pulse $\phi$1 has a voltage of high level, and thus the transfer thyristor $T_2$ is turned on. Then, the potential of the gate electrode $G_2$ drops from 5 V of $V_{GK}$ to approximately 0 V. The effect of this potential drop is transmitted to the gate electrode $G_3$ through the diode $D_2$, and accordingly the potential of the gate electrode $G_3$ is set to approximately 1 V (a forward rising voltage (equal to a diffusion potential) of the diode $D_2$). However, since the diode $D_1$ is reverse biased, the effect of the potential drop is not transmitted to the gate electrode $G_1$, and thus the potential of the gate electrode $G_1$ remains 5 V. Here, a turned-on potential of a writing light-emitting thyristor is approximated by adding a potential of the gate electrode and a diffusion potential (approximately 1 V) of a pn junction. Accordingly, only the transfer thyristor $T_3$ may be turned on while the other transfer thyristors may remain turned off, if the H level voltage of the transfer clock pulse $\phi$2 is set to a value more than approximately 2 V (voltage required to turn on the transfer thyristor $T_3$) and lower than approximately 4 V (voltage required to turn on the transfer thyristor $T_4$). In this way, the turned-on states are transferred among the transfer thyristors by using the two transfer clock pulses.

The start pulse $\phi_S$ is a pulse for starting the above-described transfer operation. The start pulse $\phi_S$ is set to an L level (approximately 0 V), and at the same time the transfer clock pulse $\phi$2 is set to an H level (approximately 2 V to approximately 4 V), which makes the transfer thyristor $T_1$ get turned on. Immediately after that, the start signal $\phi_S$ is set back to the H level.

Assume that the transfer thyristor $T_2$ is currently turned on. In this case, the potential of the gate electrode $G_2$ is approximately 0 V after dropping from $V_{GK}$ (assumed here to be 5 V). Accordingly, the light-emitting element $L_2$ may be made to emit light, if the voltage of the write signal $\phi_I$ is set not lower than the diffusion potential (approximately 1 V) of the pn junction.

On the other hand, the gate electrodes $G_1$ and $G_3$ are set to approximately 5 V and approximately 1 V, respectively. Accordingly, the write voltages of the light-emitting elements $L_1$ and $L_3$ are approximately 6 V and approximately 2 V, respectively. Hence, the voltage of the write signal $\phi_I$ to allow only the light-emitting element $L_2$ to perform writing is within a range from 1 V to 2 V. Once the light-emitting element $L_2$ gets turned on, that is, starts emitting light, the light-emission intensity thereof is given depending on the amount of the current flowing in the write signal $\phi_I$. This allows the light-emitting element $L_2$ to perform image writing at any intensity. Meanwhile, in order to transfer the turned-on state from a light-emitting element to the next light-emitting element, it is necessary to make the voltage of the write signal $\phi_I$ line temporarily drop to 0 V to temporarily turn off the light-emitting element that is currently emitting light.

Here, when such a self-scanning light-emitting element array chip is used as each light-emitting element array chip 100, the clock pulses $\phi$1 and $\phi$2 may be transmitted by using the clock pulse lines 74 and 76 commonly for the multiple light-emitting element array chips 100. However, the write signal line 78 to supply therethrough the write signal $\phi_I$ for controlling blinking of the light-emitting elements, needs to be provided for each of the light-emitting element array chips 100. For example, the light-emitting element array 51 using 60 light-emitting element array chips 100 requires 60 write signal lines 78. In order to route such many write signal lines 78, the printed circuit board 52 on which the light-emitting element array chips 100 are provided needs to be increased in width. Instead, a multilayer board may be used as the printed circuit board 52, which however increases in cost.

Figure 6A:
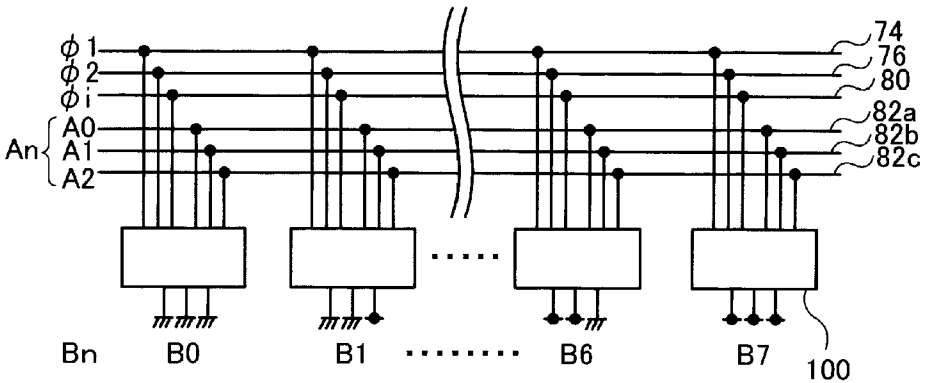
FIGS. 6A to 6C are a first example of a wiring diagram illustrating the light-emitting element array chips and the signal lines provided therearound which are used in the present exemplary embodiment; a timing chart of the write signal and the identification signal; and a diagram illustrating an example of each identification signal discrimination circuit.

FIG. 6A is a first example of a wiring diagram illustrating the light-emitting element array chips 100 and the signal lines provided therearound, which are used in the exemplary embodiment.

In the wiring diagram shown in FIG. 6A, the multiple light-emitting element array chips 100 are arranged in an array in the first scan direction. In addition, the signal lines are arranged to be electrically connected to the light-emitting element array chips 100, and thus various signals are transmitted thereto through the signal lines. The signal lines are formed of the clock pulse lines 74 and 76, write signal lines 80, and identification signal lines 82*a*, 82*b* and 82*c*. The clock pulses $\phi$1 and $\phi$2 are transmitted to the light-emitting element array chips 100 through the clock pulse lines 74 and 76, respectively. Write signals $\phi$i are transmitted as light-emission control signals to the light-emitting element array chips 100 through the respective write signal lines 80. Identification signals An are transmitted to the light-emitting element array chips 100 through the respective identification signal lines 82*a*, 82*b* and 82*c*.

Each light-emitting element array chip 100 is an aforementioned self-scanning light-emitting element array chip. Note that, although arrayed in a zigzag pattern as illustrated in FIG. 3 to be exact, the light-emitting element array chips 100 are shown here in FIG. so as to be arrayed in a line, for simplicity. Among the multiple, for example 60, arrayed light-emitting element array chips 100, FIG. 6A shows eight light-emitting element array chips 100 assigned numbers of 0 to 7, which will be referred to as B0 to B7 of the light-emitting element array chips 100, respectively. Meanwhile, the other light-emitting element array chips 100 are also divided into groups each including eight light-emitting element array chips 100, so that the 60 light-emitting element array chips 100 are divided into eight groups in total.

The clock pulse lines 74 and 76 are usable commonly for all the light-emitting element array chips 100, as described above. All the light-emitting element array chips 100 in each light-emitting element array 51 (see FIG. 3) are controllable by using these two signal lines.

Through the write signal lines 80, the write signals ϕi for the light-emitting elements in the light-emitting element array chips 100 are transmitted. In the present exemplary embodiment, the write signal lines 80 are connected to the respective divided groups. Specifically, since the light-emitting element array chips 100 are divided into eight groups in the present exemplary embodiment, eight write signal lines 80 exist in total in the light-emitting element array 51. Note that, in the present exemplary embodiment, the write signal lines 80 are not directly connected to the write signal lines 78 illustrated in FIG. 5. The write signal lines 80 are provided for the respective light-emitting element array chips 100, and connected to the write signal lines 78 via identification signal discrimination circuits (not shown in the figure). Each identification signal discrimination circuit is an identification-signal discrimination unit that discriminates the identification signal, and that transmits the light-emission control signal to the LEDs 102, which are the light-emitting elements.

An identification signal generating circuit (not shown in the figure) generates and transmits the identification signal An to the light-emitting element array chips 100 through the identification signal lines 82*a*, 82*b* and 82*c*. The identification signal An is a signal for identifying which of B0 to B7 of the light-emitting element array chips 100 is to be controlled. In the present exemplary embodiment, the three identification signal lines 82*a*, 82*b* and 82*c* are capable of transmitting 1-bit signals A0, A1 and A2 therethrough, respectively, and thus are capable of transmitting a 3-bit identification signal An in total. Therefore, the identification signal An indicating 0 to 7 may be transmitted through the three identification signal lines 82*a*, 82*b* and 82*c*. From the identification signal lines 82*a*, 82*b* and 82*c*, three signal lines are provided for each group of the divided light-emitting element array chips 100. Thus, since the light-emitting element array chips 100 are divided into eight groups in the present exemplary embodiment, 24 signal lines exist in total in each light-emitting element array 51.

Next, a description will be given of an operation of the circuit formed of the light-emitting element array chips 100 and the signal lines as described above.

In order to cause any one of B0 to B7 of the light-emitting element array chips 100, firstly the identification signal generating circuit (not shown in the figure) generates the identification signal An, which is a 3-bit signal as described above. Through the identification signal lines 82*a*, 82*b* and 82*c*, the identification signal An is transmitted to the unillustrated identification signal discrimination circuits provided respectively in these eight light-emitting element array chips 100. Simultaneously, a write signal generating circuit (not shown in the figure) generates and transmits the write signal ϕi to the eight light-emitting element array chips 100 through the write signal line 80. Note that the identification signal generating circuit and the write signal generating circuit in the present exemplary embodiment may be collectively regarded as a signal generation unit. The signal generation unit generates the light-emission control signal when generating the identification signal An corresponding to a control target chip among the light-emitting element array chips in the group. As a result, the write signal ϕi is transmitted asynchronously with the identification signal An.

Each identification signal discrimination circuit is capable of discriminating the identification signal An indicating 0 to 7. For example, upon receiving the identification signal An indicating "0," the identification signal discrimination circuit provided in B0 discriminates that the identification signal An is for the light-emitting element array chip 100 corresponding to itself. On the other hand, the identification signal discrimination circuits respectively provided in B1 to B7 discriminate that the identification signal An is for the light-emitting element array chip 100 corresponding to another identification signal discrimination circuit. The identification signal discrimination circuit provided in B0 transmits, as the write signal $\phi_I$, the write signal ϕi, which has been simultaneously transmitted through the write signal line 80, to the corresponding write signal line 78 illustrated in FIG. 5. As a result, the light-emitting elements in B0 of the light-emitting element array chips 100 sequentially emit light in accordance with the write signal ϕi. Note that, in the present exemplary embodiment, when then receiving the identification signal An indicating "0" again, the identification signal discrimination circuit provided in B0 regards the identification signal An as a signal to stop emitting light. Thus, in this case, the light-emitting elements in B0 of the light-emitting element array chips 100 stop emitting light in accordance with the identification signal An. In other words, a toggle operation between turning-on and turning-off of the light emission is performed.

Figure 6B:
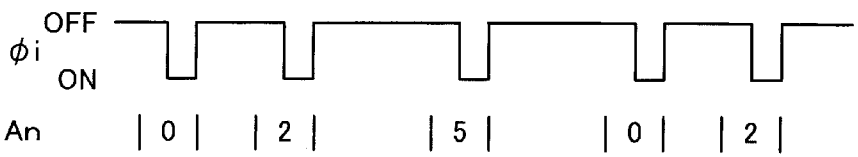

FIG. 6B is a diagram illustrating a timing chart of the write signal ϕi and the identification signal An in this case.

In the example shown in FIG. 6B, firstly, the identification signal An indicating "0" is transmitted, and simultaneously the write signal ϕi becomes ON. Upon receiving these two signals, B0 of the light-emitting element array chips 100 performs a light-emitting operation. Then, after a predetermined period, this time the identification signal An indicating "2" and the identification signal An indicating "5" are sequentially transmitted. Since the write signal ϕi becomes ON simultaneously, in accordance with these two received signals, B2 and B5 of the light-emitting element array chips 100 sequentially perform the light-emitting operation. Then, the identification signal An indicating "0" is transmitted, and simultaneously the write signal ϕi becomes ON. Upon receiving these two signals, the toggle operation is performed to cause B0 of the light-emitting element array chips 100 to perform an emission-stopping operation, in this case. This is because B0 of the light-emitting element array chips 100 is currently performing the light-emitting operation. Thereafter, the identification signal An indicating "2" is further transmitted, and simultaneously the write signal ϕi becomes ON. Upon receiving these signals, this time B2 of the light-emitting element array chips 100 performs the emission-stopping operation, because being currently performing the light-emitting operation.

Figure 6C:
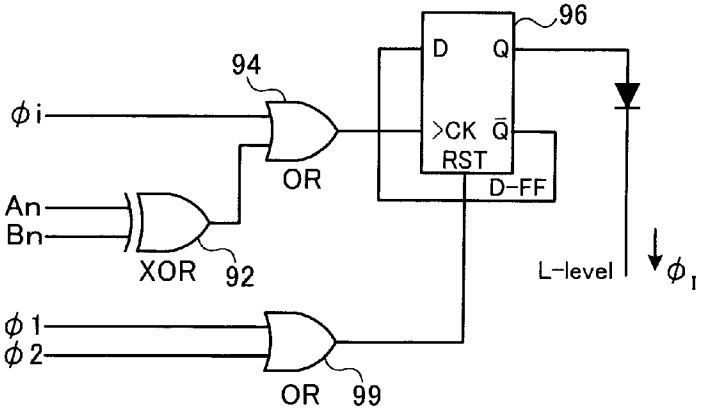

FIG. 6C is a diagram illustrating an example of each identification signal discrimination circuit.

The identification signal discrimination circuit shown in FIG. 6C is formed of an XOR gate 92, an OR gate 94, a flip flop 96 and an OR gate 99. The XOR gate 92 implements exclusive disjunction of the identification signal An and a signal Bn. The signal Bn indicates the same number as assigned to the light-emitting element array chip 100. The OR gate 94 implements logical disjunction of an output signal from the XOR gate 92 and the write signal ϕi. The flip flop 96 is provided for the toggle operation. The OR gate 99 implements logical disjunction of the clock pulses ϕ1 and ϕ2.

The XOR gate 92 determines whether or not the identification signal An coincides with the signal Bn by implementing exclusive disjunction of the identification signal An and the signal Bn. If the identification signal An coincides with the signal Bn, the XOR gate 92 transmits the output signal indicating ON to the OR gate 94, but, if not, the XOR gate 92 remains OFF. If the identification signal An coincides with the signal Bn, the OR gate 94 is allowed to transmit the write signal ϕi to the flip flop 96 by implementing logical disjunction of the output signal from the XOR gate 92 and the write signal ϕi. In other words, in the present exemplary embodiment, when the values respectively indicated by An and Bn coincide with each other, the write signal ϕi reaches the flip flop 96.

In the present exemplary embodiment, a D-type flip flop is used as the flip flop 96. In this case, a signal state of an input D at the rising timing of a clock input CK is outputted to and maintained at an output Q. In other words, if the input D is set to "ON" at the rising timing of the clock input CK, the output Q is also set to "ON." By contrast, if the input D is set to "OFF" at that timing, the output Q is also set to "OFF." Thereafter, the state of the output Q is maintained irrespective of the state of the input D until the next clock rising edge is inputted. In the present exemplary embodiment, the write signal ϕi that reaches the flip flop 96 is then inputted to the clock input CK. Accordingly, if Q bar is "OFF," Q bar is switched to "ON," and also input D is switched to "ON" at the same time. As a result, the output Q is also set to "ON," and thus the write signal ϕi is outputted from the output Q. Since the output Q is connected to the write signal line 78 provided for the light-emitting element array chip 100, the write signal ϕi is transmitted as the write signal $\phi_I$, therethrough, which causes the light-emitting element array chip 100 to perform the light-emitting operation.

When the values respectively indicated by An and Bn coincide with each other again, the write signal ϕi reaches the flip flop 96 and is thus inputted to the clock input CK, again. This sets Q bar to "OFF," and input D to "OFF" at the same time. As a result, the output Q is also set to "OFF," which causes the light-emitting element array chip 100 to perform the emission-stopping operation. In other words, the toggle operation between turning-on and turning-off of light emission is performed.

To the RST terminal of the flip flop 96, the logical disjunction of the clock pulses ϕ1 and ϕ2 is inputted from the OR gate 99. In a case where a self-scanning light-emitting element array chip is used as each of the light-emitting element array chips 100 in the present exemplary embodiment, both of the clock pulses ϕ1 and ϕ2 become "L" when the transfer occurs. Since the output from the OR gate 99 becomes "ON" at this time, the flip flop 96 is caused to be reset at this timing. Thus, the output Q is forcibly set to the L-level.

By configuring the signal lines as in the present exemplary embodiment, the number of signal lines may be reduced. Assume here that "pre-reduction number" denotes the original number of write signal lines, that "post-reduction number" denotes the sum of the number of write signal lines 80 (the number of signal lines for ϕi) and the number of identification signal lines 82*a*, 82*b* and 82*c* (the number of signal lines for An) in the present exemplary embodiment, and that "dividing number" denotes the number of light-emitting element array chips 100 for each of multiple groups into which the light-emitting element array chips 100 are divided. Then, the post-reduction number may be calculated by the following expression:

(post-reduction number)=[(pre-reduction number)/(dividing number)]rounded up to integer×((the number of signal lines for ϕ*i*)+(the number of signal lines for *An*)).

In the present exemplary embodiment, for each group, the number of signal lines for ϕpi is 1, and the required numbers of signal lines for An are 3, 2 and 1 when the dividing numbers are 8 (eighth time-division), 4 (fourth time-division) and 2 (second time-division), respectively.

Table 1 shows the post-reduction numbers in the present exemplary embodiment calculated using the above expression where the pre-reduction numbers are 60 and 40.

TABLE 1

| EIGHTH TIME-DIVISION | | FOURTH TIME-DIVISION | | SECOND TIME-DIVISION | |
|---|---|---|---|---|---|
| PRE-REDUCTION | POST-REDUCTION | PRE-REDUCTION | POST-REDUCTION | PRE-REDUCTION | POST-REDUCTION |
| 60 | 32 | 60 | 45 | 60 | 60 |
| 40 | 20 | 40 | 30 | 40 | 40 |

As is clear from Table 1, the present exemplary embodiment achieves reduction in the number of signal lines in most cases.

Figure 7A:
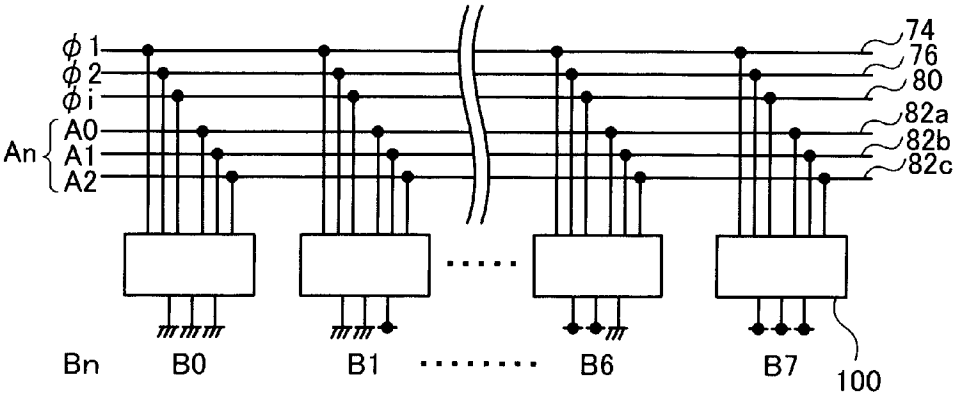
FIGS. 7A to 7C are a second example of a wiring diagram illustrating the light-emitting element array chips and the signal lines provided therearound which are used in the present exemplary embodiment; a timing chart of the write signal and the identification signal; and a diagram illustrating an example of each identification signal discrimination circuit.

FIG. 7A is a second example of a wiring diagram illustrating the light-emitting element array chips 100 and the signal lines provided therearound which are used in the present exemplary embodiment.

The wiring diagram shown in FIG. 7A is the same as that shown in FIG. 6A in the layout of the light-emitting element array chips 100, the clock pulse lines 74 and 76, the write signal lines 80, and the identification signal lines 82*a*, 82*b* and 82*c*. However, in the wiring diagram shown in FIG. 6A, the three identification signal lines 82*a*, 82*b* and 82*c* are provided for each of the groups into which the light-emitting element array chips 100 are divided. Thus the 24 identification signal lines in total exist for the eight groups. Meanwhile, in the wiring diagram shown in FIG. 7A, the identification signal lines 82*a*, 82*b* and 82*c* are provided in common for each of the groups. Thus only the three identification signal lines exist for all the eight groups. Note that the write signal lines 80 are connected to the respective divided groups. In other words, one write signal line 80 is provided for each group, and thus eight write signal lines 80 exist for all the eight groups.

Then, a description will be given of an operation of the circuit formed of the light-emitting element array chips 100 and the signal lines as described above.

The identification signal generating circuit (not shown in the figure) generates and transmits the identification signal An repeatedly and sequentially indicating 0 to 7, through the identification signal lines 82*a*, 82*b* and 82*c*. The write signal generating circuit (not shown in the figure) simultaneously generates and transmits the write signal ϕi through the write signal line 80. It is only when the identification signal An indicating the light-emitting element array chip 100 intended to emit light is transmitted that the write signal ϕi is transmitted. In other words, the signal generation unit formed of the identification signal generating circuit and the write signal generating circuit generates the identification signal sequentially indicating each of the light-emitting element array chips in a group, and generates the light-emission control signal when the identification signal corresponding to the control target light-emitting element array chip is generated. As a result, the write signal ϕi is transmitted in synchronization with the identification signal An indicating the light-emitting element array chip 100 intended to emit light.

Each of the unillustrated identification-signal discrimination circuits provided respectively in the light-emitting element array chips 100 discriminates the identification signal An indicating 0 to 7. For example, upon receiving the identification signal An indicating "0," the identification signal discrimination circuit provided in B0 discriminates that the identification signal An is for the light-emitting element array chip 100 corresponding to itself. If B0 of the light-emitting element array chips 100 receives the write signal ϕi at that time, the light-emitting elements therein sequentially emit light in accordance with the write signal ϕi. However, if B0 of the light-emitting element array chips 100 does not receive the write signal ϕi simultaneously with the identification signal An, the light-emitting elements therein does not perform the light-emitting operation.

Note that, when receiving the write signal ϕi in synchronization with the identification signal An indicating "0" again after performing the light-emitting operation, the identification signal discrimination circuit provided in B0 regards these signals as a signal to stop emitting light. Thus, in this case, the light-emitting elements in B0 of the light-emitting element array chips 100 stop emitting light in accordance with the identification signal An. In other words, the toggle operation between turning-on and turning-off of light emission is performed.

Note that, since one write signal line 80 is provided for each group, the light-emitting element array chips 100 is controllable for each group.

Figure 7B:
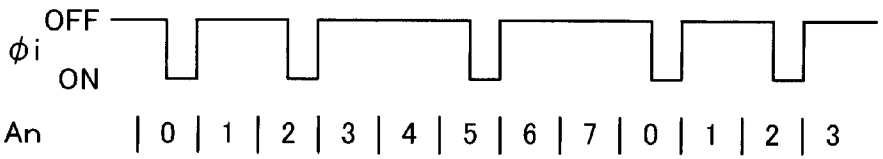

FIG. 7B is a diagram illustrating a timing chart of the write signal ϕi and the identification signal An.

In the example shown in FIG. 7B, firstly, the identification signal An indicating "0" and the write signal ϕi are transmitted in synchronization with each other. Upon receiving these two signals, B0 of the light-emitting element array chips 100 performs the light-emitting operation. Then, after a predetermined period, this time the identification signal An indicating "2" and the identification signal An indicating "5" are sequentially transmitted. Since the write signal ϕi becomes ON simultaneously, in accordance with these two received signals, B2 and B5 of the light-emitting element array chips 100 sequentially perform the light-emitting operation. Then, the identification signal An indicating "0" and the write signal ϕi are simultaneously transmitted. Upon receiving these two signals, the toggle operation is performed to cause B0 of the light-emitting element array chips 100 to perform the emission-stopping operation, in this case. This is because B0 of the light-emitting element array chips 100 is currently performing the light-emitting operation. Thereafter, the identification signal An indicating "2" is further transmitted, and simultaneously the write signal ϕi becomes ON. Upon receiving these signals, this time B2 of the light-emitting element array chips 100 performs the emission-stopping operation, because being currently performing the light-emitting operation. Note that, when being intended to adjust the length of a light-emitting period, it may be performed by adjusting the rising timing of the write signal $\phi_I$ in a range where the identification signal An takes a constant value.

Figure 7C:
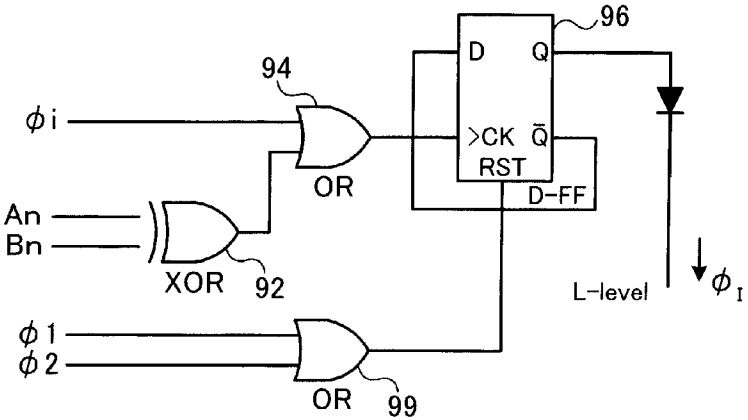

FIG. 7C is a diagram illustrating an example of each identification signal discrimination circuit.

The identification signal discrimination circuit shown in FIG. 7C has the same configuration and performs the same operation as those of the identification signal discrimination circuit shown in FIG. 6C.

Assume here that "pre-reduction number" denotes the original number of write signal lines, that "post-reduction number" denotes the sum of the number of write signal lines 80 and the number of identification signal lines 82*a*, 82*b* and 82*c* (the number of signal lines for An) in the present exemplary embodiment, and that "dividing number" denotes the number of light-emitting element array chips 100 for each of multiple groups into which the light-emitting element array chips 100 are divided. Then, the post-reduction number may be calculated by the following expression:

(post-reduction number)=[(pre-reduction number)/dividing number)]rounded up to integer+(the number of signal lines for *An*).

In the present exemplary embodiment, the required numbers of signal lines for An are 3, 2 and 1 when the dividing numbers are 8 (eighth time-division), 4 (fourth time-division) and 2 (second time-division), respectively.

Table 2 shows the post-reduction numbers in the present exemplary embodiment calculated using the above expression where the pre-reduction numbers are 60 and 40.

TABLE 2

| EIGHTH TIME-DIVISION | | FOURTH TIME-DIVISION | | SECOND TIME-DIVISION | |
|---|---|---|---|---|---|
| PRE-REDUCTION | POST-REDUCTION | PRE-REDUCTION | POST-REDUCTION | PRE-REDUCTION | POST-REDUCTION |
| 60 | 11 | 60 | 17 | 60 | 31 |
| 40 | 8 | 40 | 12 | 40 | 21 |

As is clear from Table 2, the present exemplary embodiment achieves reduction in the number of signal lines in every case. In addition, Table 2 shows that the second example has a larger reduction effect than the first example shown in Table 1.

Figure 8A:
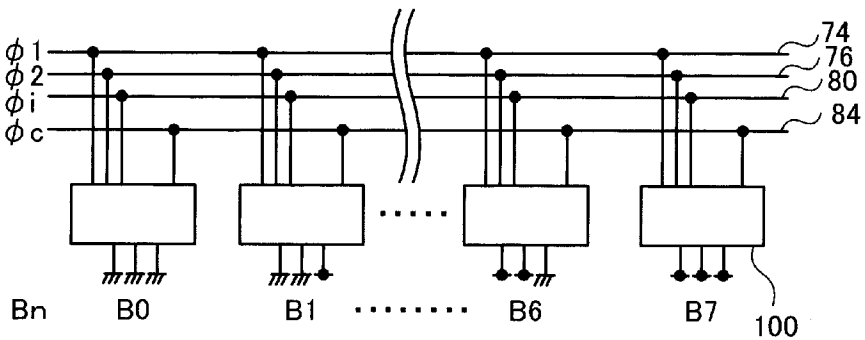
FIGS. 8A to 8C are a third example of a wiring diagram illustrating the light-emitting element array chips and the signal lines provided therearound which are used in the present exemplary embodiment; a timing chart of the write signal, the counter signal and the accumulated counter value; and a diagram illustrating an example of each identification signal discrimination circuit and an accumulator that accumulates the counter signal.

FIG. 8A is a third example of a wiring diagram illustrating the light-emitting element array chips 100 and the signal lines provided therearound which are used in the present exemplary embodiment.

The wiring diagram shown in FIG. 8A is the same as that shown in FIG. 6A in the layout of the light-emitting element array chips 100, the clock pulse lines 74 and 76, and the write signal lines 80. However, none of the identification signal lines 82*a*, 82*b* and 82*c* are provided, and a counter signal line 84 is provided, instead. The counter signal line 84 is provided in common for each of the groups. Thus only this single counter signal line 84 exists for all the eight groups. Note that the write signal lines 80 are connected to the respective divided groups. In other words, one write signal line 80 is provided for each group, and thus eight write signal lines 80 exist for all the eight groups.

Then, a description will be given of an operation of the circuit formed of the light-emitting element array chips 100 and the signal lines as described above.

Firstly, a counter signal generating circuit (not shown in the figure) generates and transmits a counter signal ϕc to the light-emitting element array chips 100 through the counter signal line 84. The write signal generating circuit (not shown in the figure) simultaneously generates and transmits the write signal ϕi through the write signal line 80. It is only when an accumulated counter value Qn reaches a predetermined value that the write signal ϕi is transmitted. In other words, the write signal ϕi is transmitted synchronously when the number assigned to the light-emitting element array chip 100 intended to emit light coincides with the accumulated counter value Qn.

Each of the unillustrated identification signal discrimination circuits provided respectively in the light-emitting element array chips 100 calculates the accumulated counter value Qn as an identification signal. For example, when the accumulated counter value Qn is "0," the identification signal discrimination circuit provided in B0 discriminates that the accumulated counter value Qn is the identification signal for the light-emitting element array chip 100 corresponding to itself. If B0 of the light-emitting element array chips 100 receives the write signal ϕi at that time, the light-emitting elements therein sequentially emit light in accordance with the write signal ϕi. However, if B0 of the light-emitting element array chips 100 does not receive the write signal ϕi simultaneously with the identification signal, the light-emitting elements therein do not perform the light-emitting operation.

Note that, when receiving the write signal ϕi in synchronization with the change of the accumulated counter value Qn to "0" again after performing the light-emitting operation, the identification signal discrimination circuit provided in B0 regards the accumulated counter value Qn to be an identification signal to stop emitting light. Thus, in this case, the light-emitting elements in B0 of the light-emitting element array chips 100 stop emitting light in accordance with this identification signal. In other words, the toggle operation between turning-on and turning-off of light emission is performed.

Note that, since one write signal line 80 is provided for each group, the light-emitting element array chips 100 is controllable for each group.

Figure 8B:
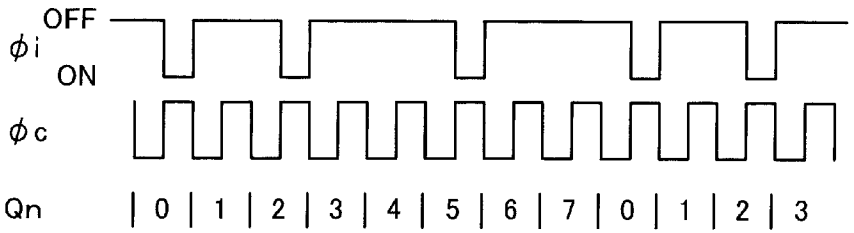

FIG. 8B is a diagram illustrating a timing chart of the write signal ϕi, the counter signal ϕc, and the accumulated counter value Qn.

In the example shown in FIG. 8B, the counter signal ϕc is transmitted at regular time intervals. The counter signal ϕc is accumulated as the accumulated counter value Qn. The accumulated counter value Qn starts from "0," and is reset to "0" after accumulated until "7," which is repeated. In the present exemplary embodiment, the write signal ϕi is transmitted synchronously when the accumulated counter value Qn is "0." Upon receiving these two signals, B0 of the light-emitting element array chips 100 performs the light-emitting operation. Then, after a predetermined period, this time the write signal ϕi is transmitted synchronously when the accumulated counter value Qn is "2" and "5," respectively. In accordance with these two received signals, B2 and B5 of the light-emitting element array chips 100 sequentially perform the light-emitting operation. Then, the write signal ϕi is transmitted synchronously when the accumulated counter value Qn is "0." Upon receiving these two signals, the toggle operation is performed to cause B0 of the light-emitting element array chips 100 to perform the emission-stopping operation, in this case. This is because B0 of the light-emitting element array chips 100 is currently performing the light-emitting operation. Thereafter, the write signal ϕi is transmitted synchronously when the accumulated counter value Qn is "2." Upon receiving these signals, this time B2 of the light-emitting element array chips 100 performs the emission-stopping operation, because being currently performing the light-emitting operation.

Figure 8C:
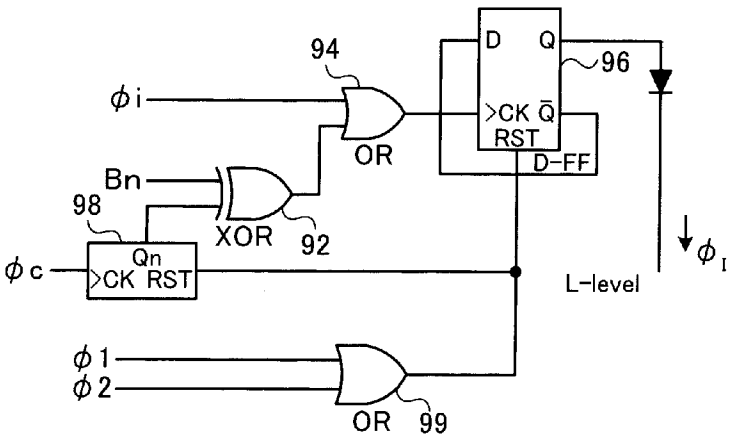

FIG. 8C is a diagram illustrating an example of each identification signal discrimination circuit and an accumulator that accumulates the counter signal ϕc.

An accumulator 98 shown in FIG. 8C accumulates the counter signal ϕc transmitted through the counter signal line 84, and transmits the accumulated counter value Qn as an identification signal to the identification signal discrimination circuit. The accumulation of the counter signal ϕc starts from "0," and is reset to "0" after accumulated until "7," which is repeated. In the present exemplary embodiment, the accumulator 98 may be regarded as the signal generation unit that generates an identification signal, and generates the identification signal from the accumulated value of the counter signal. Meanwhile, a portion of the identification signal discrimination circuit other than the accumulator 98 in the present exemplary embodiment may be regarded as the identification signal discrimination unit.

The identification signal discrimination circuit is formed of the XOR gate 92, the OR gate 94, the flip flop 96 and an OR gate 99. The XOR gate 92 implements exclusive disjunction of the accumulated counter value Qn and the signal Bn. The signal Bn indicates the same number as assigned to the light-emitting element array chip 100. The OR gate 94 implements logical disjunction of an output signal from the XOR gate 92 and the write signal ϕi. The flip flop 96 is provided for the toggle operation. The OR gate 99 implements logical disjunction of the clock pulses ϕ1 and ϕ2. In other words, the identification signal discrimination circuit in FIG. 8C has a configuration and performs an operation similar to those of the identification signal discrimination circuit shown in FIG. 6C.

Assume here that "pre-reduction number" denotes the original number of write signal lines, that "post-reduction number" denotes the sum of the number of write signal lines 80 and the number of counter signal lines 84 (the number of signal lines for ϕc) in the present exemplary embodiment, and that "dividing number" denotes the number of light-emitting element array chips 100 for each of multiple groups into which the light-emitting element array chips 100 are divided. Then, the post-reduction number may be calculated by the following expression:

(post-reduction number)=[(pre-reduction number)/dividing number)]rounded up to integer+(the number of signal lines for ϕ*c*).

In the present exemplary embodiment, the required number of signals ϕc is 1.

Table 3 shows the post-reduction numbers in the present exemplary embodiment calculated using the above expression where the pre-reduction numbers are 60 and 40.

TABLE 3

| EIGHTH TIME-DIVISION | | FOURTH TIME-DIVISION | | SECOND TIME-DIVISION | |
|---|---|---|---|---|---|
| PRE-REDUCTION | POST-REDUCTION | PRE-REDUCTION | POST-REDUCTION | PRE-REDUCTION | POST-REDUCTION |
| 60 | 9 | 60 | 16 | 60 | 31 |
| 40 | 6 | 40 | 11 | 40 | 21 |

As is clear from Table 3, the present exemplary embodiment achieves reduction in the number of signal lines in every case. In addition, Table 3 shows that the third example has a much larger reduction effect than the first and second examples shown in Tables 1 and 2.

Figure 9A:
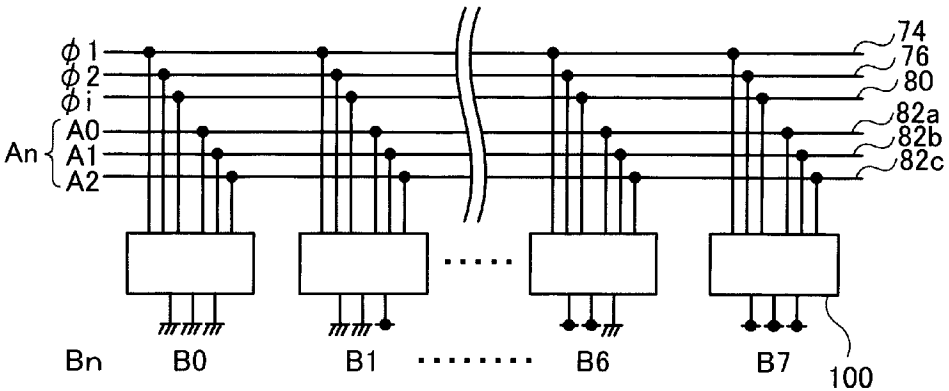
FIGS. 9A to 9C are a fourth example of a wiring diagram illustrating the light-emitting element array chips and the signal lines provided therearound which are used in the present exemplary embodiment; a timing chart of the write signal, the clock pulses and the identification signal; and a diagram illustrating an example of each identification signal discrimination circuit.

FIG. 9A is a fourth example of a wiring diagram illustrating the light-emitting element array chips 100 and the signal lines provided therearound which are used in the present exemplary embodiment.

The wiring diagram shown in FIG. 9A is the same as that shown in FIG. 6A in the layout of the light-emitting element array chips 100, the clock pulse lines 74 and 76, the write signal lines 80, and the identification signal lines 82*a*, 82*b* and 82*c*.

An operation of the circuit formed of the light-emitting element array chips 100 and the signal lines as described above is as follows. As for the light-emitting operation, the same operation is performed as that described for FIG. 6A. However, as for the emission-stopping operation, an operation to cause all B0 to B7 of the light-emitting element array chips 100 to stop emitting light at the same time is performed by use of the signals of the clock pulses ϕ1 and ϕ2.

Figure 9B:
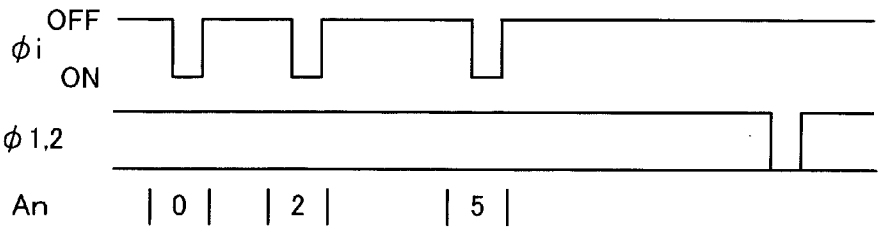

FIG. 9B is a diagram illustrating a timing chart of the write signal ϕi, the clock pulses ϕ1 and ϕ2, and the identification signal An in this case.

In the example shown in FIG. 9B, firstly, the identification signal An indicating "0" is transmitted, and simultaneously the write signal ϕi becomes ON. Upon receiving these two signals, B0 of the light-emitting element array chips 100 performs a light-emitting operation. Then, after a predetermined period, this time the identification signal An indicating "2" and the identification signal An indicating "5" are sequentially transmitted. Since the write signal ϕi becomes ON simultaneously, in accordance with these two received signals, B2 and B5 of the light-emitting element array chips 100 sequentially perform the light-emitting operation.

When being intended to stop emitting light, the light-emitting element array chips 100 may be caused to perform the emission-stopping operation by use of the signals of the clock pulses ϕ1 and ϕ2. In this case, a light-emitting period of B0, B2 and B5 of the light-emitting element array chips 100 is a period from receiving the identification signal to receiving the clock pulses ϕ1 and ϕ2, which cause the light-emitting element array chips 100 to perform the emission-stopping operation.

Figure 9C:
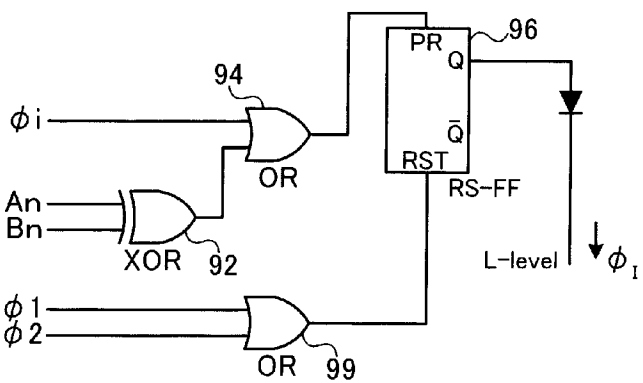

FIG. 9C is a diagram illustrating an example of each identification signal discrimination circuit.

The identification signal discrimination circuit shown in FIG. 9C is formed of the XOR gate 92, the OR gate 94, the flip flop 96 and an OR gate 99. The XOR gate 92 implements exclusive disjunction of the identification signal An and the signal Bn. The signal Bn indicates the same number as assigned to the light-emitting element array chip 100. The OR gate 94 implements logical disjunction of an output signal from the XOR gate 92 and the write signal ϕi. The OR gate 99 implements logical disjunction of the clock pulses ϕ1 and ϕ2.

The XOR gate 92 determines whether or not the identification signal An coincides with the signal Bn by implementing exclusive disjunction of the identification signal An and the signal Bn. If the identification signal An coincides with the signal Bn, the XOR gate 92 transmits the output signal indicating ON to the OR gate 94, but, if not, the XOR gate 92 remains OFF. If the identification signal An coincides with the signal Bn, the OR gate 94 is allowed to transmit the write signal ϕi to the flip flop 96 by implementing logical disjunction of the output signal from the XOR gate 92 and the write signal ϕi. In other words, in the present exemplary embodiment, when the values respectively indicated by An and Bn coincide with each other, the write signal ϕi reaches the flip flop 96.

In the present exemplary embodiment, a RS-type flip flop is used as the flip flop 96. In this case, a signal state at the rising timing of an input PR is outputted to and maintained at an output Q. In the present exemplary embodiment, the write signal ϕi that reaches the flip flop 96 is then inputted to the input PR. As a result, the write signal ϕi is outputted from the output Q. Since the output Q is connected to the write signal line 80 provided for the light-emitting element array chip 100, the write signal ϕi is transmitted as the write signal $\phi_I$ therethrough, which causes the light-emitting element array chip 100 to perform the light-emitting operation.

In addition, the emission-stopping operation is allowed to be performed irrespective of the identification-signal discrimination circuit shown in FIG. 9C, because the emission-stopping operation is performed by resetting the flip flop 96 with the signals of the clock pulses ϕ1 and ϕ2.

To the RST terminal of the flip flop 96, the logical disjunction of the clock pulses ϕ1 and ϕ2 is inputted from the OR gate 99. In the case where a self-scanning light-emitting element array chip is used as each of the light-emitting element array chips 100 in the present exemplary embodiment, both of the clock pulses ϕ1 and ϕ2 become "L" when the transfer occurs. Since the output from the OR gate 99 becomes "ON" at this time, the flip flop 96 is caused to be reset at this timing. Thus, the output Q is forcibly set to the L-level.

Assume here that "pre-reduction number" denotes the original number of write signal lines, that "post-reduction number" denotes the sum of the number of write signal lines 80 (the number of signal lines for ϕi) and the number of identification signal lines 82*a*, 82*b* and 82*c* (the number of signal lines for An) in the present exemplary embodiment, and that "dividing number" denotes the number of light-emitting element array chips 100 for each of multiple groups into which the light-emitting element array chips 100 are divided. Then, the post-reduction number may be calculated by the following expression:

(post-reduction number)=[(pre-reduction number)/dividing number)]rounded up to integer×((the number of signal lines for ϕ*i*)+(the number of signal lines for *An*)).

In the present exemplary embodiment, for each group, the number of signal lines for ϕi is 1, and the required numbers of signal lines for An are 3, 2 and 1 when the dividing numbers are 8 (eighth time-division), 4 (fourth time-division) and 2 (second time-division), respectively.

Table 4 shows the post-reduction numbers in the present exemplary embodiment calculated using the above expression where the pre-reduction numbers are 60 and 40.

TABLE 4

| EIGHTH TIME-DIVISION | | FOURTH TIME-DIVISION | | SECOND TIME-DIVISION | |
|---|---|---|---|---|---|
| PRE-REDUCTION | POST-REDUCTION | PRE-REDUCTION | POST-REDUCTION | PRE-REDUCTION | POST-REDUCTION |
| 60 | 32 | 60 | 45 | 60 | 60 |
| 40 | 20 | 40 | 30 | 40 | 40 |

As is clear from Table 4, the present exemplary embodiment achieves reduction in the number of signal lines in most cases.

Figure 10A:
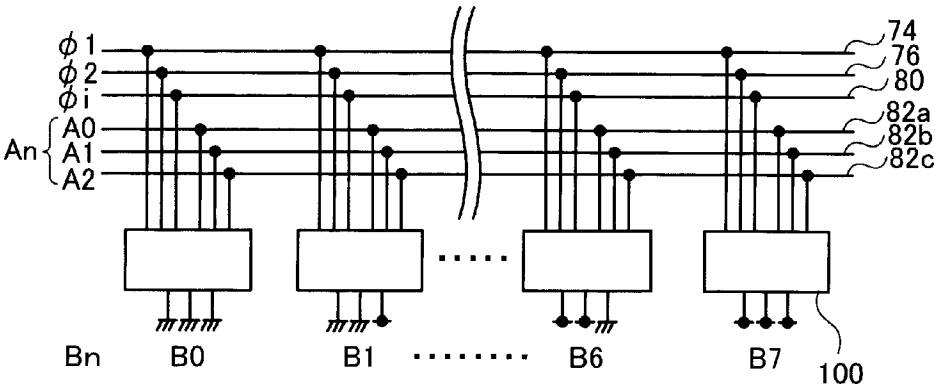
FIGS. 10A to 10C are a fifth example of a wiring diagram illustrating the light-emitting element array chips and the signal lines provided therearound which are used in the present exemplary embodiment; a timing chart of the write signal, the clock pulses and the identification signal; and a diagram illustrating an example of each identification signal discrimination circuit.

FIG. 10A is a fifth example of a wiring diagram illustrating the light-emitting element array chips 100 and the signal lines provided therearound which are used in the present exemplary embodiment.

The wiring diagram shown in FIG. 10A is the same as that shown in FIG. 7A in the layout of the light-emitting element array chips 100, the clock pulse lines 74 and 76, the write signal lines 80, and the identification signal lines 82*a*, 82*b* and 82*c*. That is, the identification signal lines 82*a*, 82*b* and 82*c* are provided in common for the light-emitting element array chips 100 arrayed in the light-emitting element array 51, and thus only one identification signal line exists. Furthermore, an operation of the circuit formed of the light-emitting element array chips 100 and the signal lines as described above is as follows. As for the light-emitting operation, the same operation is performed as that described for FIG. 7A. However, as for the emission-stopping operation, an operation to cause all B0 to B7 of the light-emitting element array chips 100 to stop emitting light at the same time is performed by use of the signals of the clock pulses ϕ1 and ϕ2.

Figure 10B:
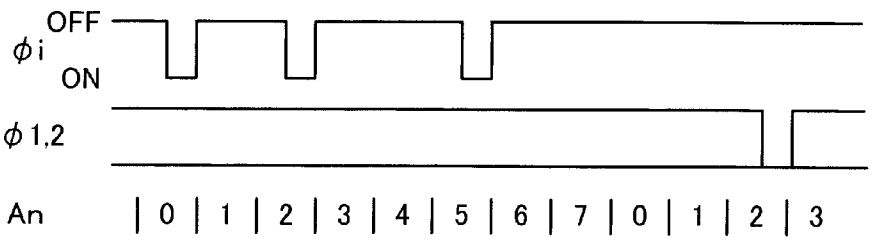

FIG. 10B is a diagram illustrating a timing chart of the write signal ϕi, the clock pulses ϕ1 and ϕ2, and the identification signal An in this case.

In the example shown in FIG. 10B, firstly, the identification signal An indicating "0" and the write signal ϕi are transmitted in synchronization with each other. Upon receiving these two signals, B0 of the light-emitting element array chips 100 performs the light-emitting operation. Then, after a predetermined period, this time the identification signal An indicating "2" and the identification signal An indicating "5" are sequentially transmitted. Since the write signal ϕi becomes ON simultaneously, in accordance with these two received signals, B2 and B5 of the light-emitting element array chips 100 sequentially perform the light-emitting operation. Meanwhile, when the light-emitting element array chips 100 are intended to stop emitting light, the emission-stopping operation is performed by use of the signals of the clock pulses ϕ1 and ϕ2, like the case described for FIG. 9B.

Figure 10C:
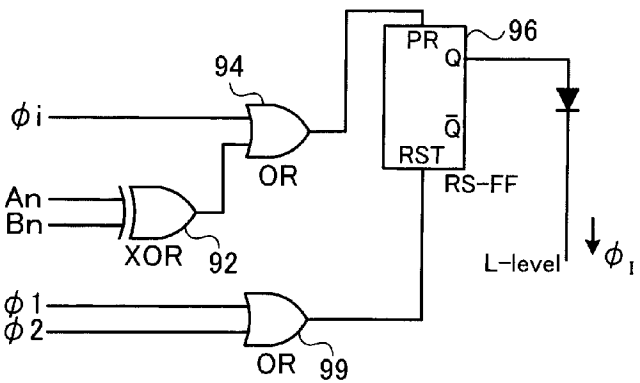

FIG. 10C is a diagram illustrating an example of each identification signal discrimination circuit.

The identification signal discrimination circuit shown in FIG. 10C is formed of the XOR gate 92, the OR gate 94, the flip flop 96 and an OR gate 99. The XOR gate 92 implements exclusive disjunction of the identification signal An and the signal Bn. The signal Bn indicates the same number as assigned to the light-emitting element array chip 100. The OR gate 94 implements logical disjunction of an output signal from the XOR gate 92 and the write signal ϕi. The flip flop 96 is provided for the toggle operation. The OR gate 99 implements logical disjunction of the clock pulses ϕ1 and ϕ2. The identification signal discrimination circuit in FIG. 10C has a configuration and performs an operation similar to those of the identification signal discrimination circuit shown in FIG. 9C.

Assume here that "pre-reduction number" denotes the original number of write signal lines, that "post-reduction number" denotes the sum of the number of write signal lines 80 and the number of identification signal lines 82*a*, 82*b* and 82*c* (the number of signal lines for An) in the present exemplary embodiment, and that "dividing number" denotes the number of light-emitting element array chips 100 for each of multiple groups into which the light-emitting element array chips 100 are divided. Then, the post-reduction number may be calculated by the following expression:

(post-reduction number)=[(pre-reduction number)/dividing number)]rounded up to integer+(the number of signal lines for *An*).

In the present exemplary embodiment, the required numbers of signal lines for An are 3, 2 and 1 when the dividing numbers are 8 (eighth time-division), 4 (fourth time-division) and 2 (second time-division), respectively.

Table 5 shows the post-reduction numbers in the present exemplary embodiment calculated using the above expression where the pre-reduction numbers are 60 and 40.

TABLE 5

| EIGHTH TIME-DIVISION | | FOURTH TIME-DIVISION | | SECOND TIME-DIVISION | |
|---|---|---|---|---|---|
| PRE-REDUCTION | POST-REDUCTION | PRE-REDUCTION | POST-REDUCTION | PRE-REDUCTION | POST-REDUCTION |
| 60 | 11 | 60 | 17 | 60 | 31 |
| 40 | 8 | 40 | 12 | 40 | 21 |

As is clear from Table 5, the present exemplary embodiment achieves reduction in the number of signal lines in every case. In addition, Table 5 shows that the fifth example has a larger reduction effect than the fourth example shown in Table 4.

Figure 11A:
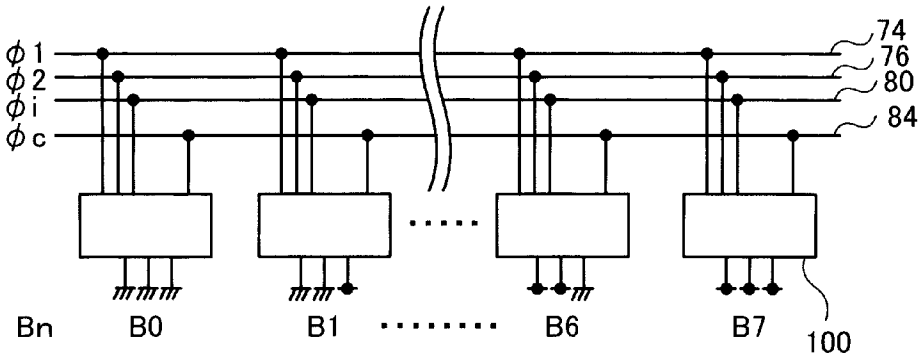
FIGS. 11A to 11C are a sixth example of a wiring diagram illustrating the light-emitting element array chips and the signal lines provided therearound which are used in the present exemplary embodiment; a timing chart of the write signal, the clock pulses, the counter signal and the accumulated counter value; and a diagram illustrating an example of each identification signal discrimination circuit and an accumulator that accumulates the counter signal.

FIG. 11A is a sixth example of a wiring diagram illustrating the light-emitting element array chips 100 and the signal lines provided therearound which are used in the present exemplary embodiment.

The wiring diagram shown in FIG. 11A is the same as that shown in FIG. 8A in the layout of the light-emitting element array chips 100, the clock pulse lines 74 and 76, and the write signal lines 80.

An operation of the circuit formed of the light-emitting element array chips 100 and the signal lines as described above is as follows. As for the light-emitting operation, the same operation is performed as that described for FIG. 8A. However, as for the emission-stopping operation, an operation to cause all B0 to B7 of the light-emitting element array chips 100 to stop emitting light at the same time is performed by use of the signals of the clock pulses ϕ1 and ϕ2.

Figure 11B:
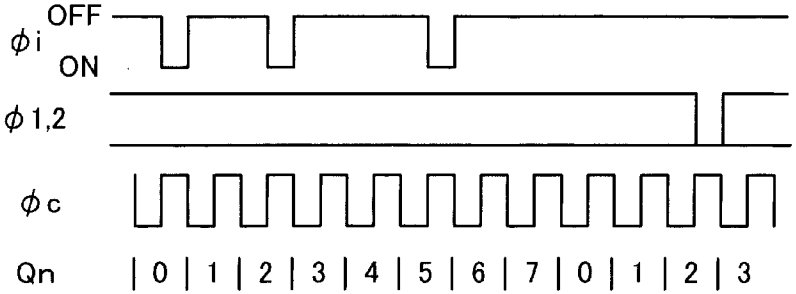

FIG. 11B is a diagram illustrating a timing chart of the write signal ϕi, the clock pulses ϕ1 and ϕ2, the counter signal ϕc, and the accumulated counter value Qn.

In the example shown in FIG. 11B, the counter signal ϕc is transmitted at regular time intervals. The counter signal ϕc is accumulated as the accumulated counter value Qn. The accumulated counter value Qn starts from "0," and is reset to "0" after accumulated until "7," which is repeated.

In the present exemplary embodiment, the write signal ϕi is transmitted synchronously when the accumulated counter value Qn is "0." Upon receiving these two signals, B0 of the light-emitting element array chips 100 performs the light-emitting operation. Then, after a predetermined period, this time the write signal ϕi is transmitted synchronously when the accumulated counter value Qn is "2" and "5," respectively. In accordance with these two received signals, B2 and B5 of the light-emitting element array chips 100 sequentially perform the light-emitting operation.

When being intended to stop emitting light, the light-emitting element array chips 100 may be caused to perform the emission-stopping operation by use of the signals of the clock pulses ϕ1 and ϕ2. In this case, the light-emitting period of B0, B2 and B5 of the light-emitting element array chips 100 is a period from receiving the identification signal to receiving the clock pulses ϕ1 and ϕ2, which cause the light-emitting element array chips 100 to perform the emission-stopping operation.

Figure 11C:
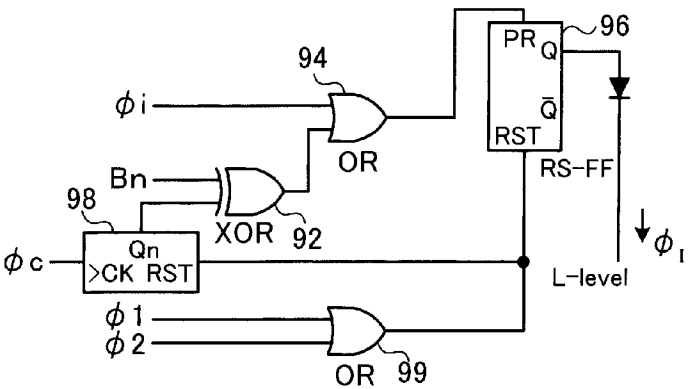

FIG. 11C is a diagram illustrating an example of each identification signal discrimination circuit and an accumulator that accumulates the counter signal ϕc.

An accumulator 98 shown in FIG. 11C accumulates the counter signal ϕc transmitted through the counter signal line 84, and transmits the accumulated counter value Qn as an identification signal to the identification signal discrimination circuit. The accumulation of the counter signal ϕc starts from "0," and is reset to "0" after accumulated until "7," which is repeated. In the present exemplary embodiment, the accumulator 98 may be regarded as the signal generation unit that generates an identification signal.

The identification signal discrimination circuit is formed of the XOR gate 92, the OR gate 94, the flip flop 96 and an OR gate 99. The XOR gate 92 implements exclusive disjunction of the accumulated counter value Qn and the signal Bn. The signal Bn indicates the same number as assigned to the light-emitting element array chip 100. The OR gate 94 implements logical disjunction of an output signal from the XOR gate 92 and the write signal ϕi. The OR gate 99 implements logical disjunction of the clock pulses ϕ1 and ϕ2. The identification signal discrimination circuit in FIG. 11C has a configuration and performs an operation similar to those of the identification signal discrimination circuit shown in FIG. 9C.

Assume here that "pre-reduction number" denotes the original number of write signal lines, that "post-reduction number" denotes the sum of the number of write signal lines 80 and the number of counter signal lines 84 (the number of signal lines for ϕc) in the present exemplary embodiment, and that "dividing number" denotes the number of light-emitting element array chips 100 for each of multiple groups into which the light-emitting element array chips 100 are divided. Then, the post-reduction number may be calculated by the following expression:

(post-reduction number)=[(pre-reduction number)/dividing number)]rounded up to integer+(the number of signal lines for ϕc).

In the present exemplary embodiment, the required number of signals ϕc is 1.

Table 6 shows the post-reduction numbers in the present exemplary embodiment calculated using the above expression where the pre-reduction numbers are 60 and 40.

TABLE 6

| EIGHTH TIME-DIVISION | | FOURTH TIME-DIVISION | | SECOND TIME-DIVISION | |
|---|---|---|---|---|---|
| PRE-REDUCTION | POST-REDUCTION | PRE-REDUCTION | POST-REDUCTION | PRE-REDUCTION | POST REDUCTION |
| 60 | 9 | 60 | 16 | 60 | 31 |
| 40 | 6 | 40 | 11 | 40 | 21 |

As is clear from Table 6, the present exemplary embodiment achieves reduction in the number of signal lines in every case. In addition, Table 6 shows that the sixth example has a much larger reduction effect than the fourth and fifth examples shown in Tables 4 and 5.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A light-emitting element head comprising:

a plurality of light-emitting element array chips that are divided into a plurality of groups and assigned an identification signal number, and that each are provided with light-emitting elements arranged in an array;

a signal generation unit that generates a light-emission control signal for controlling blinking of the light-emitting elements, and an identification signal including identification signal number information for identifying which of the light-emitting element array chips in each of the groups the light-emission control signal is for;

signal lines through which the light-emission control signal and the identification signal are transmitted, wherein only one of the signal lines through which the light-emission control signal is transmitted is respectively connected to each of the groups; and identification signal discrimination units that are connected to the signal lines and that are provided in the respective light-emitting element array chips, each of the identification signal discrimination units discriminating the identification signal number information included in the identification signal, and transmitting the light-emission control signal to the light-emitting elements of the light-emitting element array chip that corresponds to the assigned identification signal number that matches the identification signal number information.

2. The light-emitting element head according to claim 1, wherein the signal generation unit generates the light-emission control signal when generating the identification signal corresponding to one of the light-emitting element array chips in each of the groups, the one of the light-emitting element array chips being to be controlled.

3. The light-emitting element head according to claim 1, wherein the signal generation unit sequentially generates the identification signal corresponding to each of the light-emitting element array chips in each of the groups, and generates the light-emission control signal when the identification signal corresponding to one of the light-emitting element array chips to be controlled is generated.

4. The light-emitting element head according to claim 1, wherein the signal generation unit generates the identification signal from an accumulated value of a counter signal.

5. The light-emitting element head according to claim 1, wherein each one of the identification signal discrimination units performs a toggle operation between turning-on and turning-off of light emission for one of the light-emitting element array chips in accordance with the identification signal, when the identification signal is transmitted corresponding to the one of the light-emitting element array chips in which the one of the identification signal discrimination units is provided.

6. The light-emitting element head according to claim 1, wherein each of the light-emitting element array chips is a self-scanning light-emitting element array chip.

7. The light-emitting element head according to claim 6, wherein the self-scanning light-emitting element array chip performs an emission-stopping operation by use of a clock pulse.

8. The light-emitting element head according to claim 1, wherein identification signal discrimination units each includes an XOR gate that implements exclusive disjunction of the identification signal and a signal corresponding to the identification signal number assigned to the light-emitting elements, an OR gate that implements logical disjunction of an output signal from the XOR gate and the light-emission control signal, and a flip flop that is provided for toggle operation, the flip flop being connected to an output of the OR gate and selectively transmitting the light-emission control signal received from the OR gate.

9. An image forming apparatus comprising:

a toner image forming unit that forms a toner image;

a transfer unit that transfers the toner image onto a recording medium; and a fixing unit that fixes the toner image onto the recording medium, the toner image forming unit including a light-emitting element head having:

a plurality of light-emitting element array chips that are divided into a plurality of groups and assigned an identification signal number, and that each are provided with light-emitting elements arranged in an array;

a signal generation unit that generates a light-emission control signal for controlling blinking of the light-emitting elements, and an identification signal including identification signal number information for identifying which of the light-emitting element array chips in each of the groups the light-emission control signal is for;

signal lines through which the light-emission control signal and the identification signal are transmitted, wherein only one of the signal lines through which the light-emission control signal is transmitted is respectively connected to each of the groups; and identification signal discrimination units that are connected to the signal lines and that are provided in the respective light-emitting element array chips, each of the identification signal discrimination units discriminating the identification signal number information included in the identification signal, and transmitting the light-emission control signal to the light-emitting elements of the light-emitting element array chip that corresponds to the assigned identification signal number that matches the identification signal number information.

10. A light-emission control method for a light-emitting element head including: a plurality of light-emitting element array chips that are divided into a plurality of groups and assigned an identification signal number, and that each are provided with light-emitting elements arranged in an array, a signal generation unit that generates signals, signal lines through which the signals are transmitted, wherein only one of the signal lines through which a light-emission control signal is transmitted is respectively connected to each of the groups, and circuits that are connected to the signal lines and that are provided in the respective light-emitting element array chips, the light-emission control method comprising:

generating, by the signal generation unit, a light-emission control signal for controlling blinking of the light-emitting elements, and an identification signal including identification signal number information for identifying which of the light-emitting element array chips in each of the groups the light-emission control signal is for;

performing, by the circuits, discrimination of the identification signal number information included in the identification signal; and transmitting, by the circuits, the light-emission control signal to the light-emitting elements of the light-emitting element array chip that corresponds to the assigned identification signal number that matches the identification signal number information, in accordance with the discrimination.

* * * * *